US005520547A

United States Patent [19]

Hamaoka et al.

[11] Patent Number: 5,520,547

[45] Date of Patent: May 28, 1996

[54] CORROSION-FREE ELECTRICAL CONNECTOR STRUCTURE

[75] Inventors: Takashi Hamaoka, Kariya; Atsushi Nagata, Anjo, both of Japan

[73] Assignee: Nippondenso Co., Ltd., Kariya, Japan

[21] Appl. No.: 308,492

[22] Filed: Sep. 21, 1994

[30] Foreign Application Priority Data

Sep. 27, 1993 [JP] Japan ..... 5-240039

[51] Int. Cl.[6] ..... H01R 4/60

[52] U.S. Cl. ..... 439/206

[58] Field of Search ..... 439/190, 199, 439/201, 204, 205, 206

[56] References Cited

U.S. PATENT DOCUMENTS

| | | | |
|---|---|---|---|
| 4,534,609 | 8/1985 | White . | |
| 4,845,393 | 7/1989 | Burgess et al. . | |
| 4,952,753 | 8/1990 | Hayashi et al. . | |
| 5,141,410 | 8/1992 | Fujii . | |
| 5,276,307 | 1/1994 | Higgins | 439/206 X |

FOREIGN PATENT DOCUMENTS

| | | |
|---|---|---|
| 58-140982 | 8/1983 | Japan . |
| 3-23359 | 1/1991 | Japan . |
| 4-351865 | 12/1992 | Japan . |
| 635743 | 4/1950 | United Kingdom . |
| 2178603 | 2/1987 | United Kingdom . |
| 2275135 | 8/1994 | United Kingdom . |

OTHER PUBLICATIONS

IBM Technical Disclosure Bulletin, vol. 29, No. 8 Jan. 1987.

*Primary Examiner*—Khiem Nguyen
*Attorney, Agent, or Firm*—Cushman Darby & Cushman

[57] ABSTRACT

Disclosed is a corrosion-free connector-structure of a fuel pump used in a vehicle fuel supply system. An electrical connector portion of a fuel pump is shaped into a square tube and its tubular wall is formed with a lock window for engagement with an engagement nail of a female connector and a fluid discharge port at an upper and lower portion thereof, respectively. As gasoline fuel level in the fuel tank lowers, the connector portion is exposed to air in the fuel tank and gasoline in the upper space within the connector portion or tubular wall pushes down and discharges water and degraded gasoline remaining in the lower space within the connector portion through the discharge port. Since water and degraded gasoline will not remain within the connector portion, electrical connector members or electrodes may be prevented from corrosion.

13 Claims, 2 Drawing Sheets

CORROSION-FREE ELECTRICAL CONNECTOR STRUCTURE

BACKGROUND OF THE INVENTION

1. Field of the Invention

The present invention relates to a corrosion-free electrical connector structure and more particularly to an electrical connector structure which is positioned in a fuel tank and prevents corrosion of electrodes for power supply to a fuel pump.

2. Related Art

In-tank type fuel pump is known in the art as disclosed in JP-A-3-23359. The fuel pump of this kind is placed vertically or upright in a fuel within a fuel tank or in a sub-tank placed in the fuel tank. The pump has at its uppermost portion an electrical connector of a tubular shape for receiving electric power supply for an electric motor. As shown in FIG. 5A, a female connector 103 connected to a power supply source is inserted and fitted into a tubular wall 101 of a male connector of the pump and an engagement nail 105 of female connector 103 engages with a lock window or opening 107 of wall 101. It is also known to form lock window 107 in a slit shape extending to the lowermost portion as shown in FIG. 5B.

In the case of the fuel tank used for an automotive vehicle, fuel sometimes contains small amount of water. Since the specific gravity of the water is higher than that of the fuel, water may be accumulated gradually within the tubular wall of the connector during repetition of increase and decrease of fuel liquid level in the fuel tank. This will result in corrosion of connector electrodes.

In addition, accumulation of degraded fuel in the tubular wall of the connector will bring about corrosion of the connector electrodes.

The above accumulation of water is caused more often in the case of the connector, which has a closed bottom and a cup-shaped inner space as shown in FIG. 5A. Further, even in the case of the connector with slit 107 extending from the top to the bottom as shown in FIG. 5B, water in the fuel tends to stick to the angled corner at the inside of the connector due to surface tension. As a result, only fuel can be discharged through slit 107 and water is accumulated, thus causing corrosion of the electrodes.

SUMMARY OF THE INVENTION

It is therefore a primary object of the present invention to prevent corrosion of electrodes of an electrical connector placed in fuel within a fuel tank.

It is a secondary object of the present invention to prevent corrosion of electrodes of a connector used for an in-tank type fuel pump.

According to the present invention, a liquid discharge port is formed on a tubular or cylindrical wall of an electrical connector of a fuel pump at a position lower than the lowermost portion of electrodes and flow restriction portion is provided by a predetermined distance above the discharge port. Therefore, even if the electrical connector is placed in fuel within a fuel tank and moreover it is fixed within the fuel tank in such a manner that its top end opens upwardly, the water having a higher specific gravity is easily discharged from inside of the connector before the discharge of the fuel.

It is preferred to form the discharge port at the position same as or lower than the lowermost portion of the electrodes of the connector. Further it is preferred that the flow restriction portion has a sufficient length to promote discharge of fluid from the discharge port by the weight of fluid remaining in the fluid restriction portion.

Preferably, the electric connector is used for an in-tank type fuel pump and the fuel discharge port is formed to open in a direction opposite to a fuel supply pipe of the fuel pump. By changing shape of the fuel discharge port, types of fuel pumps in different fuel supply capacity or the like can be recognized easily without sacrificing strength of the connector.

DETAILED DESCRIPTION OF THE PRESENTLY PREFERRED EMBODIMENTS

The present invention will be described in detail hereinunder with reference to preferred embodiments shown in FIGS. 1, 2A, 2B, 3, 4A and 4B.

Figure 1:
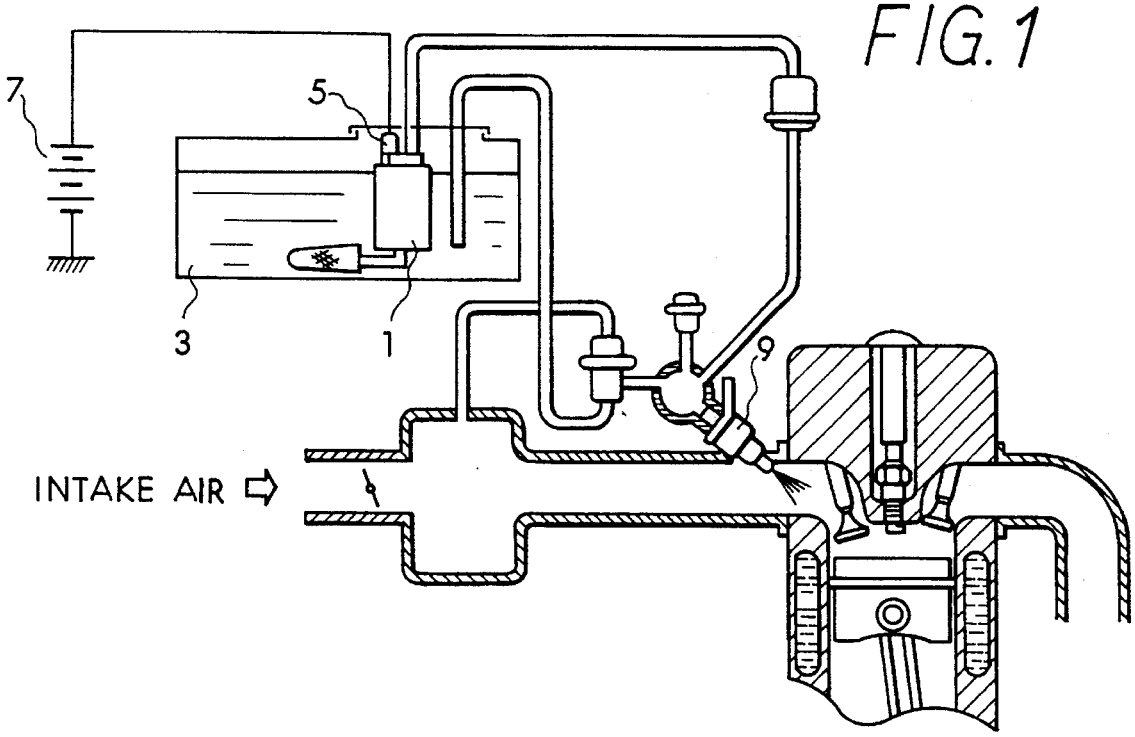
FIG. 1 is a schematic view showing a fuel supply system in which a connector structure according to the present invention is used.

A fuel supply system having a fuel pump to which a connector structure according to the present invention is used is shown in FIG. 1. As shown in this Figure, in-tank type fuel pump 1 is disposed within fuel tank 3 of an automotive fuel supply system in such a manner that it is fully coved by gasoline fuel when tank 3 is filled fully. Fuel pump 1 includes therein an electric motor which is electrically connected to storage battery 7 through electrical female connector 5 for supplying pressurized fuel to injectors 9 in a known manner.

Figure 2A:
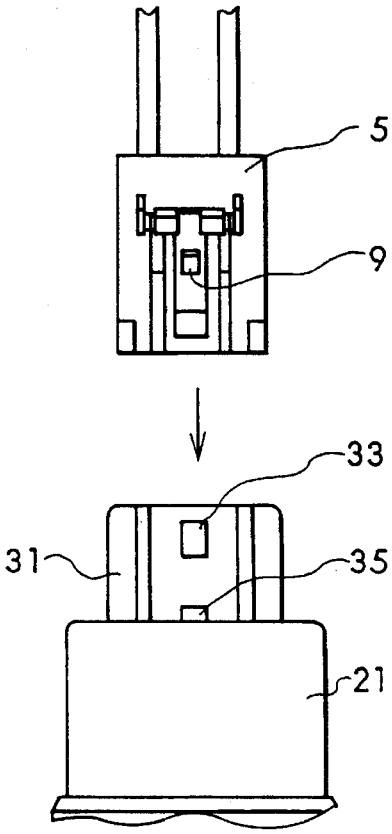
FIGS. 2A and 2B are side and cross-sectional views showing an embodiment of the connector structure and a fuel pump according to the present invention, respectively.
Figure 2B:
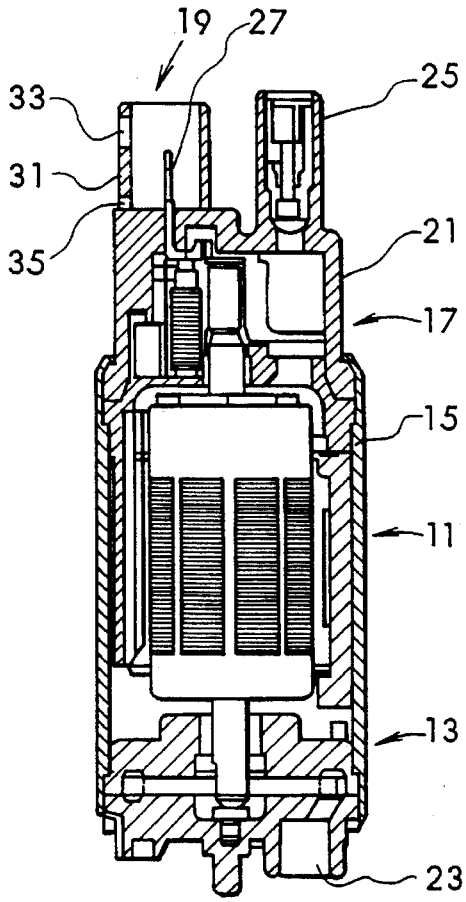

As shown in FIGS. 2A and 2B, fuel pump 1 comprises pump housing 15 which encases therein electric motor portion 11 and pump portion 13, and pump cover 21 which is mounted atop pump housing 15 and formed with outlet portion 17 and connector portion 19. Fuel inlet pipe 23 and fuel outlet or supply pipe 25 are provided at the lowermost and uppermost portions, respectively. Electric power is supplied to motor portion 11 through electrical conductive terminals or electrodes 27 extending through connector portion 19 to which female or power-supply side connector 5 having electrodes connected to storage battery 7 is coupled.

Connector portion 19 is shaped into a squared tube with a closed bottom. A lock window 33 is formed on an upper portion of tubular wall 31 to lock an engagement nail 9 of female connector 5, while small fluid discharge pot 35 is formed on a lowermost portion of tubular wall 31. No opening is formed within a predetermined range (central portion of tubular wall 31) between a lower hem of lock window 33 and an upper hem of fluid discharge port 35.

As understood from FIG. 2B, port 35 is formed at the same as or lower than the lowermost portion of tubular wall 33 from which electrodes 27 extend upwardly. Further, port 35 opens at a side opposite to and most remote from supply pipe 25.

Fuel pump 1 of the above structure is disposed in the gasoline within the fuel tank and gasoline enters into connector portion 19. Water and degraded gasoline mixed in the fuel gasoline will also enter connector portion 19. If such water and/or degraded gasoline remain within tubular wall 31 of connector portion 19, terminals 27 and female terminals (not shown) will be very likely to corrode. However, the above-described structure will discharge such water and degraded gasoline effectively and prevent corrosion in the following manner.

Figure 3:
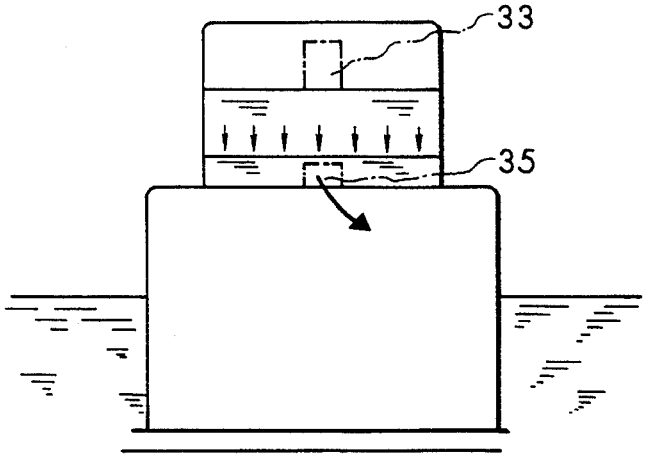
FIG. 3 is a view showing an operation of the embodiment shown in FIGS. 2A and 2B.

When gasoline fuel level in the fuel tank lowers due to fuel supply from fuel injectors to the internal combustion engine, connector portion 19 starts to be exposed to air in fuel tank 3. Since specific gravities of water and degraded gasoline are higher than that of purified or normal gasoline, they will remain at the lower portion in tubular wall 31 with the normal gasoline remaining atop it as shown in FIG. 3. With the further decrease in the gasoline fuel level and full exposure of connector portion 19 into the air, the normal gasoline within tubular wall 31 will discharge water and degraded gasoline thereunder to outside through discharge port 35. Thus, according to this embodiment, water and degraded fuel entered into connector portion 19 will be discharged out as the gasoline fuel level lowers and corrosion of electrical terminals 27 may be prevented.

Figure 4A:
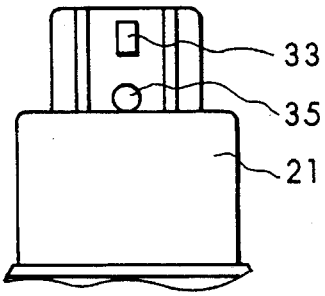
FIGS. 4A and 4B are side views showing other embodiments of the connector structure according to the present invention.
Figure 4B:
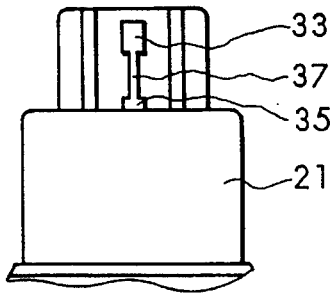
Figure 5A:
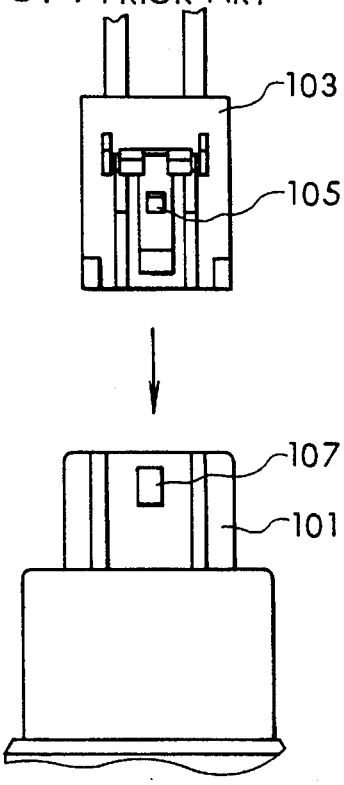
FIG. 5A PRIOR ART
FIGS. 5A and 5B are side views showing connector structures according to the prior art.
Figure 5B:
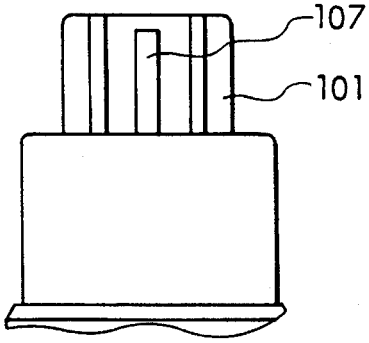
FIG. 5B PRIOR ART

The above embodiment may be modified in various ways. Discharge port 35 may be shaped into a circular hole as shown in FIG. 4A and discharge port 35 may be connected to lock window 33 through connection slit 37 narrow enough to prevent fluid flow therethrough. By those alternative shapes of discharge port 35 and further modifications of lock window 33 and discharge port 35 in size, shape, number and the like, types of fuel pumps can be recognized with ease and a variety of fuel pumps can be assembled on the same production line.

The present invention should not be construed to be limited to the foregoing embodiments but may be construed only in view of the appended claims.

What is claimed is:

1. An electrical connector for placement in fuel within a fuel tank, said connector having a tubular wall disposed within said fuel tank and opening upwardly to receive a power-supply side connector, wherein said tubular wall has:

a liquid discharge port formed at a position around an exposed lowermost portion of electrodes provided within said tubular wall and communicating an inside and an outside of said tubular wall; and a flow restriction portion provided above said discharge port and extending by a predetermined axial distance to prevent flow of said fuel from said inside to said outside of said tubular wall, whereby normal fuel within said tubular wall discharges liquid other than said normal fuel thereunder by gravity to said outside through said discharge port.

2. An electrical connector according to claim 1, wherein said tubular wall further has a lock window which engages with an engagement nail of a power-supply side connector, and wherein said flow restriction portion extends between said lock window and said discharge port.

3. An electrical connector according to claim 2, wherein said flow restriction portion is formed in a tubular shape which is circumferentially closed.

4. An electrical connector according to claim 2, wherein said flow restriction portion is formed in a tubular shape having a slit which is narrow enough to prevent discharge of said fuel therethrough by a surface tension of said fuel.

5. An electrical connector according to claim 4, wherein said flow restriction portion extends axially from said lock window to said discharge port.

6. An electrical connector according to claim 1, wherein said discharge port is formed at said lowermost portion of said cylindrical wall.

7. An electrical connector according to claim 1, wherein said electrical connector is attached to an in-tank type fuel pump.

8. An electrical connector according to claim 7, wherein said in-tank type fuel pump has a fuel supply pipe arranged in parallel with said tubular wall and said discharge port is formed opposite to said fuel supply pipe.

9. An electrical connector according to claim 8, wherein shape of said discharge port varies in accordance with type of said in-tank type fuel pump.

10. An electrical connector for an electrically operated fuel pump with a fuel supply pipe placed within a fuel tank, said connector comprising:

an electrode for an electric power supply to said fuel pump therethrough;

a bottom portion fixed to said fuel pump and fixedly supporting said electrode so that said electrode extends therefrom; and a wall portion circumferentially closed to encircle said electrode and extending from said bottom portion in the same direction as said electrode, said wall portion disposed within said fuel tank and having an opening at a position substantially the same as said bottom portion for communicating an inside and an outside of said wall portion, whereby normal fuel within said wall portion discharges liquid other than said normal fuel thereunder by gravity to said outside through said opening.

11. An electrical connector according to claim 10, wherein said opening is formed at a side opposite to said supply pipe.

12. An electrical connector according to claim 10, wherein said wall portion has a slit extending from said opening in the same direction as said opening and having a width narrow enough to prevent flow of water and degraded fuel therethrough.

13. An electrical connector for placement in fuel within a fuel tank into which a power-supply side connector extends, said electrical connector comprising:

a tubular wall disposed in said fuel tank and opening upwardly to receive said power-supply side connector;

a lock window formed on said tubular wall for engagement with said power-supply side connector;

a liquid discharge port formed on said tubular wall at a position below said lock window axially and around an exposed lowermost portion of electrodes provided within said tubular wall and communicating inside and outside of said tubular wall; and a flow restriction portion provided above said discharge port extending a predetermined axial distance to prevent flow of said fuel from said inside to said outside of said tubular wall, whereby a higher gravity portion of said fuel remaining in said tubular wall is discharged through said discharge port by a lower gravity portion of said fuel remaining above said higher gravity portion of said fuel in said tubular wall.

* * * * *